US005388892A

United States Patent [19]

Tornero

[11] Patent Number: 5,388,892

[45] Date of Patent: Feb. 14, 1995

[54] MECHANISM FOR THE RELATIVE POSITIONING OF TELESCOPING MEMBERS

[76] Inventor: Lino E. Tornero, 809 Quailmeadow La., Colfax, N.C. 27235

[21] Appl. No.: 41,859

[22] Filed: Apr. 2, 1993

[51] Int. Cl.[6] ..... A47C 7/54

[52] U.S. Cl. ..... 297/411.36; 297/411.2; 248/409

[58] Field of Search ..... 297/411.2, 411.35, 411.36, 297/423.45, 338, 344.12, 353; 248/407–409, 188.5

[56] References Cited

U.S. PATENT DOCUMENTS

| | | | |
|---|---|---|---|
| 3,802,658 | 4/1974 | Binding | 248/409 X |
| 4,012,158 | 3/1977 | Harper | 297/353 X |
| 4,036,525 | 7/1977 | Howk | 297/353 |
| 4,043,592 | 8/1977 | Fries | 297/353 X |
| 4,384,742 | 5/1983 | Wisniewski | 297/353 |
| 4,639,039 | 1/1987 | Donovan | 297/353 |
| 4,660,885 | 4/1987 | Suhr et al. | 297/353 |
| 4,749,230 | 6/1988 | Tornero | 297/353 |
| 4,786,108 | 11/1988 | Dauphin | 297/353 |
| 4,930,840 | 6/1990 | Tornero | 297/353 |
| 4,951,995 | 8/1990 | Teppo et al. | 297/411.36 |
| 5,009,467 | 4/1991 | McCoy | 297/411.36 |
| 5,265,938 | 11/1993 | Melhuish et al. | 297/411.36 |
| 5,338,133 | 8/1994 | Tornero | 297/411.37 X |

FOREIGN PATENT DOCUMENTS

| | | | |
|---|---|---|---|
| 1371641 | 10/1974 | United Kingdom | 297/353 |

OTHER PUBLICATIONS

CA Pending patent appl. Ser. No. 08/026,602, filed Mar. 5, 1993.

Prior Art 1 sketch (undated).

Prior Art 2 sketch (undated).

*Primary Examiner*—Kenneth J. Dorner

*Assistant Examiner*—Milton Nelson, Jr.

[57] ABSTRACT

A manually operated mechanism for relatively engaging and locking two structural members in a number of positions. One member includes a shroud slideably surrounding a second structural member. The shroud has a locking device for selectively engaging any of a plurality of notches on a notched member that is rigidly affixed to the structural member. Another member, such as an armrest, may be affixed to the telescoping shroud.

20 Claims, 3 Drawing Sheets

FIG. 1
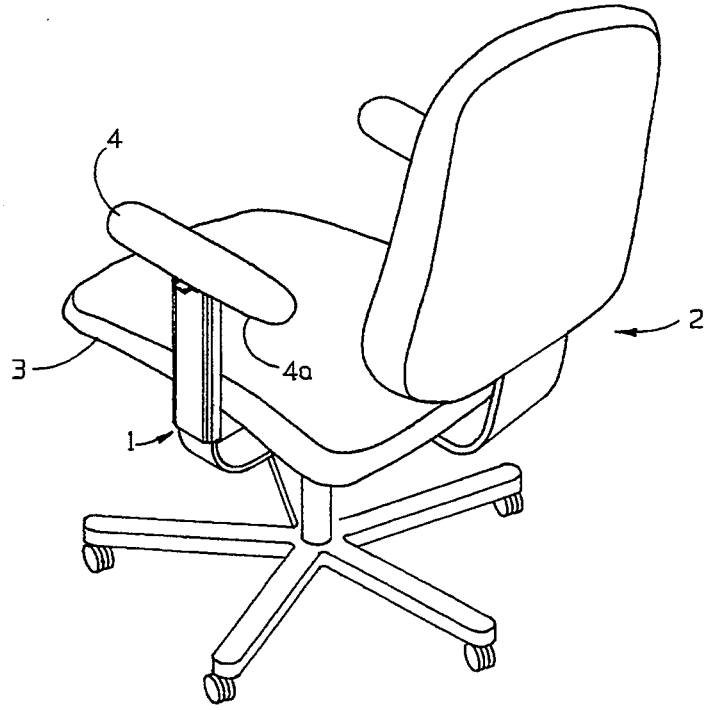
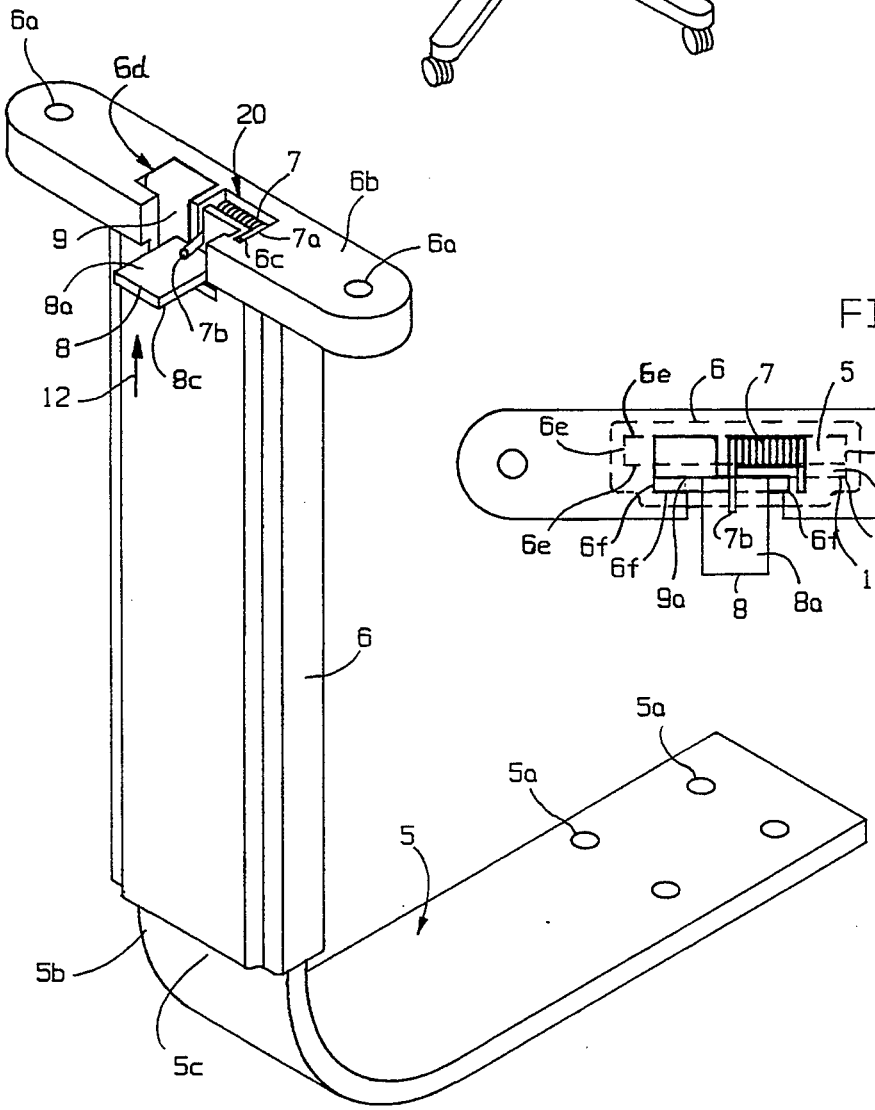
FIG. 2
FIG. 3
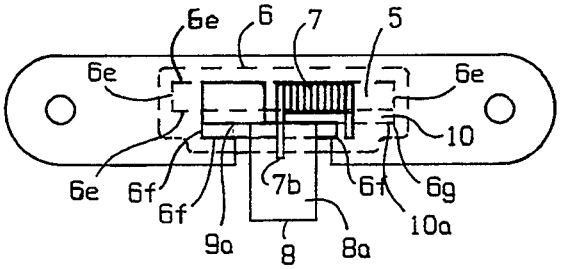

MECHANISM FOR THE RELATIVE POSITIONING OF TELESCOPING MEMBERS

BACKGROUND OF THE INVENTION

1. Field Of The Invention

The invention herein pertains to slidable structural members and particularly to furniture structural members such as arm or back supports as may be manually adjusted and operated with a release button.

2. Background And Objects Of The Invention

The present invention relates in general to mechanisms which provide for the selective adjustment and positioning of moveable structural components relative to one another. As will be seen, the device is ideally suited for use in furniture, particularly office furniture, where the current market emphasis on ergonomic design calls for adjustable furniture structures such as used with certain chairs that can be adjustably positioned to fit different individuals with various heights, weights and job tasks.

Primarily the device is intended for the positioning of components where frictional locking is not sufficient and load forces are substantial, such as is the case with the vertical adjustment of chair arms and backrests. Here the device can be advantageously used to vertically position chair arms or backs to accommodate users of different body heights and proportions.

In the prior art, chair arm vertical adjustment has been accomplished by the use of devices including telescoping members provided with knob operated frictional locking means which are strength dependent and require considerable effort on the part of the user to achieve positioning. An equal amount of effort is thus required to readjust such devices, which is inconvenient and time consuming. In addition effort required to adjust to the friction/strength dependent devices, the knobs are unsightly and interfere with other objects or the user. These friction/strength dependent devices are incapable of passing tests specified by government and industry standards and are generally considered unsafe. Also, in situations where the same chair is used by several work shifts it is often the case that occupants find it difficult to sit comfortably since adjustment of the chair between shifts is difficult and sometimes not possible. Other methods for vertical adjustment include telescoping members provided with knob operated two-toothed gears. These remain unsightly, produce loud sounds when operated and have tendency to collapse responsive to impact under certain circumstances.

It is thus an object of the present invention to provide a device for the quick yet firm, accurate manual positioning and changing of one structural component relative to another.

It is another object of the invention to provide a mechanism to allow the positioning of chair arms or backs relative to the chair set at any of a predetermined number of positions within a specific range, while doing so with an esthetically pleasing device.

SUMMARY OF THE INVENTION

It will appear clear from the subsequent specification that the device and its aforesaid objectives are not limited for use in chairs, tables or other articles of furniture but in any use where reliable and economical structural adjustment is sought. In a chair, the mechanism which comprises a fixed member with notches positioned on a structural member, for cooperation with a telescoping shroud it including attachment means for an arm pad at the top end, a shuttle member fixedly and internally located relative to the top end of the shroud and in sliding contact with the surface of said structural member (upright), and provided with a slot on one side for selective opposition to the notches on the notched member responsive to movement of the shroud. A lock pin is slideably retained within the cavity formed by the slot on the shuttle member and the internal surface of the shroud, in such a way that the shuttle member can selectably and slideably move the lock pin opposite said notches on the notched member. A trigger is located to slideably move in contact between said shuttle member, said notched member, and the internal surface of said shroud, and exhibits a slot wherein the upper portion of said lock pin is slideably retained and caused to move, responsive to manual operation of the trigger, from a position within the slot of the unlocked shuttle to a locked position within any of the notches on said notched member. When the mechanism is locked, the lock pin is partially contained within the cavity formed by one of the notches, and within the cavity of the shuttle member. In this position the lock pin interferes with the movement of the shuttle member relative to the notched member, and thus movement of the shroud relative to the upright is not possible. The mechanism remains in this locked position until the trigger is activated causing the lock pin to move within the elongated slot, at which point movement of the shroud, and the arm pad, is once again possible. The slot in the trigger is slanted so as to constantly exert a force promoting movement of the lock pin to the locked position. Although not absolutely necessary, quick movement of the lock pin to a lock position is best insured by providing a spring concealed within the top end of the shroud for constantly exerting a bias force on the trigger and forcing the lock pin into the locked position. Normally the upper end of the trigger is provided with a button which is conveniently concealed directly under the arm pad.

The advantages of the mechanism are numerous, since it is simple to manufacture and adapt to many configurations where one element is made movable relative to another. Further more the mechanism is simple to manufacture, install and operate, and by virtue of its design, can be made esthetically pleasing as it effectively conceals the operating trigger button and does not interfere with the normal use of the chair.

BRIEF DESCRIPTION OF THE DRAWINGS

FIG. 1 is a perspective view of a chair exhibiting an adjustable arm equipped with the mechanism subject of the invention;

FIG. 2 is a close up perspective view of the mechanism and includes an upright, a shroud, a trigger member, a spring, a shuttle member, and attaching means for an arm pad;

FIG. 3 is a top, phantom view of the mechanism and includes a shroud, trigger member, spring shuttle member and attaching means for an arm pad;

DETAILED DESCRIPTION OF THE DRAWINGS AND OPERATION OF THE INVENTION

Figure 6:
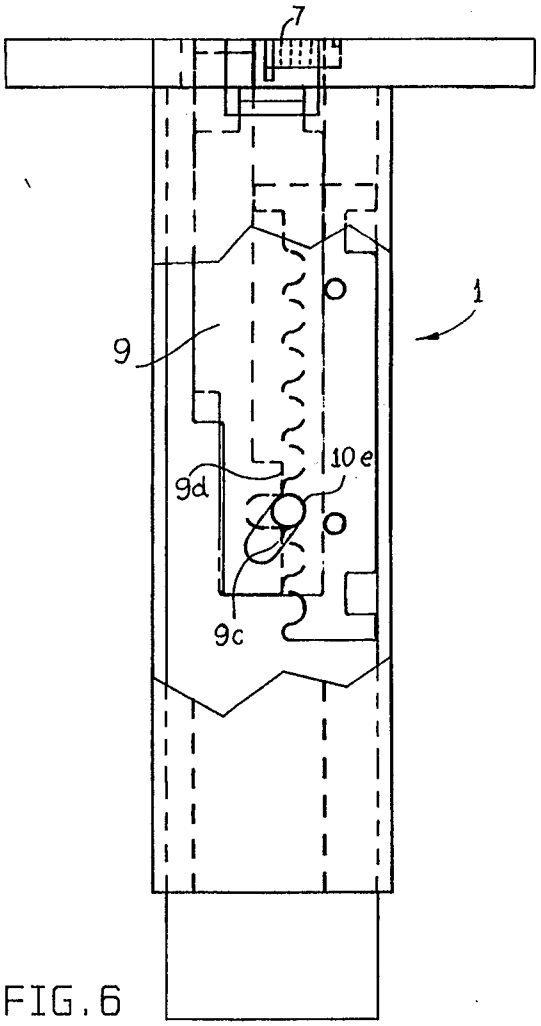
FIG. 6 is a side, phantom view of the mechanism and includes a structural member, a shroud partially removed for clarity, a spring, a shuttle member, a trigger member, a notched member, and a lock pin. The view shows the mechanism again in a locked, arbitrarily selected position relative to the structural member.

The object of the invention can be achieved in an advantageous manner by the arrangement of the elements shown in the accompanying drawings of which the following are detailed descriptions:

Referring to FIG. 1, a perspective view of an office chair 2, itself not the object of the invention, is seen with mechanism 1 attached to the underside of chair seat 3, and an arm pad 4, itself also not the object of the invention. Referring now also to FIG. 2, a perspective view of a preferred form of mechanism 1 is shown comprising structural member 5, provided with holes 5*a* for attachment to the underside of chair seat 3. Shroud 6 telescopically and slideably engaged with the upper portion 5*b* of structural member 5, holes 6*a* for attachment of said shroud 6 to the underside 4*a* of arm pad 4. A coil spring 7 is held captive within cavity 6*c* on top end 6*b* of shroud 6, in such a way that one arm 7*b* of the spring 7 exerts constant pressure on finger tab 8a of trigger member 8, while the other arm 7*a* of the spring 7 is restrained from movement within cavity 6*c* on shroud top end 6*b*. While spring 7 consists of a coil spring, other types of spring such as leaf, sinuous or torsion springs could also be employed. A cavity 6*d* is also provided on top end 6*b* for receiving and fixedly restraining shuttle member 9 from movement relative to shroud 6 after arm pad 4 is installed on shroud 6. Referring also to FIG. 3, mechanism 1 is seen from the top without arm pad 4. Structural member 5 is seen slideably guided and contained within internal walls 6*e* of shroud 6. Trigger member 8 is also slideably guided and contained within internal walls 6*f* of shroud 6 and surfaces 9*a* of shuttle 9 and surface 10*a* of notched member 10. Shuttle member 9 is restrained from all manner of movement relative to shroud 6 but is moveable and in sliding contact with surface 5*c* of structural member 5 in response to movement of shroud 6. Notched member 10 is fixedly attached to structural member 5 and is therefore in slideable contact with internal surfaces 6*g* and 6*e* of shroud 6.

Figure 5:
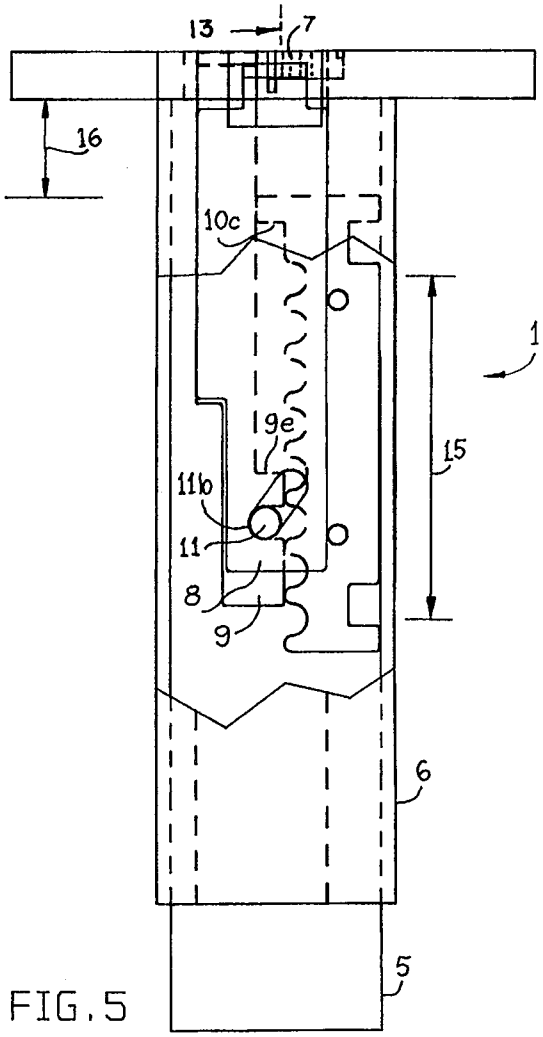
FIG. 5 is a side, phantom view of the mechanism and includes a structural member, a shroud partially removed for clarity, a spring, a shuttle member, a trigger member, a notched member, and a lock pin. The view shows the mechanism in an unlocked position.
Figure 4:
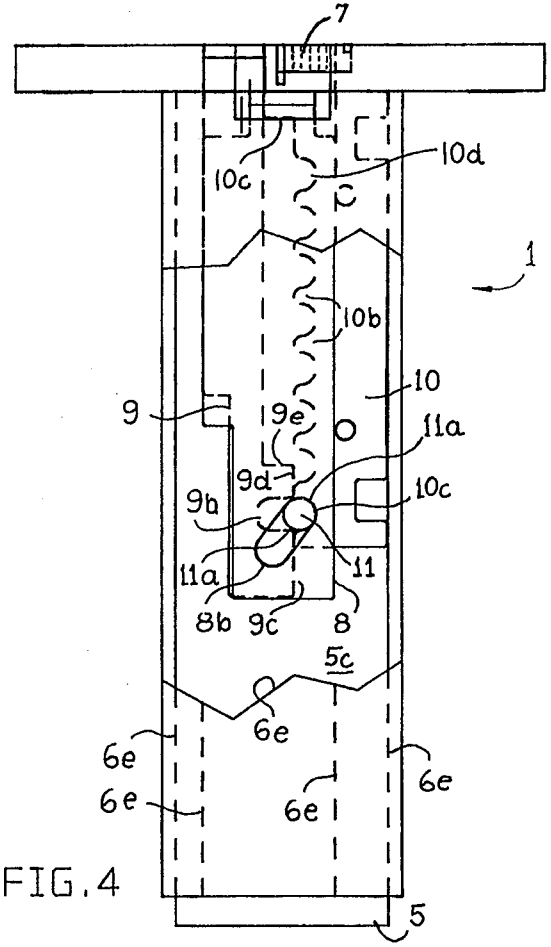
FIG. 4 is a side, phantom view of the mechanism and includes a structural member, a shroud partially removed for clarity, a spring, a shuttle member, a trigger member, a notched member, and a lock pin. The view shows the mechanism in a locked, lowermost position relative to the structural member.

Referring now to FIGS. 4, 5, and 6, lock pin 11 is slideably retained within horizontal slot 9*b* of shuttle member 9, and elongated slanted slot 8*b* of trigger member 8, notch 10*c* of notched member 10, and interior surface 6e of shroud 6. FIG. 4 also shows the superimposition of notched member 10 on surface 5*c* of structural member 5. Shuttle member 9 is slideably superimposed on surface 5*c* of structural member 5 and exhibits surfaces 9*c* and 9*d* for sliding engagement with teeth 10*b* of notched member 10. Surface 9*e* on notched member 9 when opposed to surface 10*c* on notched member 10 prevents shroud 6 from escaping engagement with structural member 5 when mechanism 1 is telescoped past last adjustment notch 10*d*.

Operation of mechanism 1 is accomplished by manually applying a force as shown by arrow 12 (FIG. 2) under finger tab 8*c* causing lock pin 11 (FIG. 4) to displace laterally and vertically relative to structural member 5 and notched member 10, from one position 11 a wherein said lock pin 11 is engaged within a notch 10*c* and mechanism 1 is in a locked state, to another position 11*b* (FIG. 5) wherein lock pin 11 is retained in the cavity 9*b* of shuttle 9 and mechanism 1 is in an unlocked state, and, simultaneously applying another force 14 (not seen) in the direction of force 12 to underside 4*a* of arm pad 4.

It can be seen in FIG. 5 that when lock pin 11 is in said unlocked position 11*b* (mechanism 1 being unlocked) shroud 6, shuttle 9, trigger member 8, and lock pin 11 are free to slideably move parallel to the central axis 13 of mechanism 1 and relative to support member 5 until surface 9*e* of shuttle 9 comes in contact with surface 10*c* of the notched member 10, wherein further movement of mechanism 1 in the direction of force 12 is restricted, and mechanism 1 can be located where desired along range 15 provided and obtaining a displacement 16 (FIG. 5). To lock mechanism 1 where desired, along range 15 the user need only remove force 12 from trigger member 8. When force 12 is removed trigger member 8 immediately causes lock pin 11 to laterally displace into a new position notch 10*e*. Since shuttle member 9 is restricted from movement due to the interference of lock pin 11 with surfaces 9*c* and 9*d* of shuttle 9 mechanism 1 is locked in that position until trigger member 8 is once more activated. While shuttle member 9 is shown separate from shroud 6 it may be formed integrally therewith. Likewise, notched member 10 may be formed integrally with structural member 5.

Figure 7:
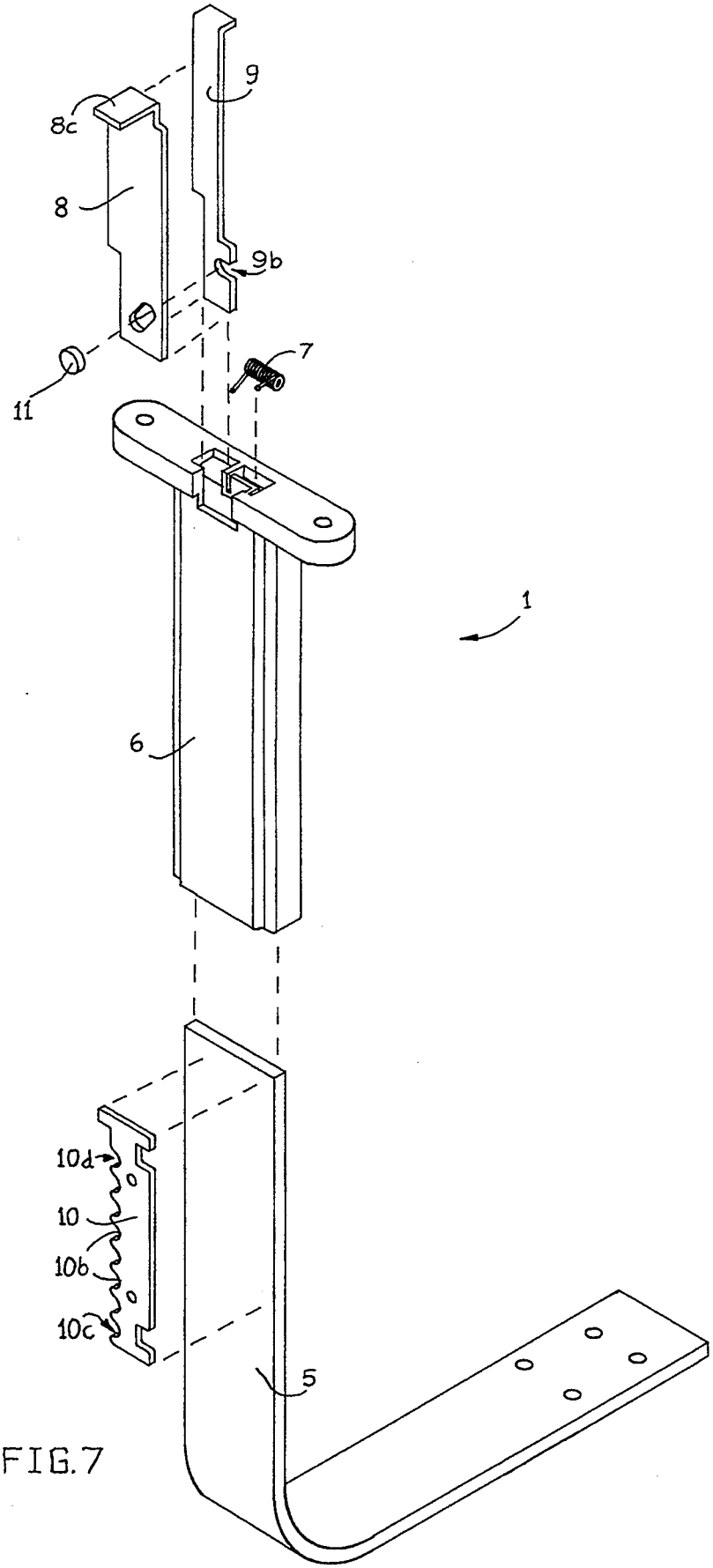
FIG. 7 is an exploded view of the trigger member, notched member and shuttle member separated from the shroud and structural member.

In FIG. 7 notched member 10 is separated from structural member 5 and removed from shroud 6. As earlier explained shuttle member 9 is rigidly affixed to shroud 6 whereas trigger member 8 is moveable therewith. Lock pin 11 comprises a cylindrically shaped component.

It is understood that the device is not limited to use in chairs, it being adaptable for use where it is necessary to releasably and lockably adjust the displacement of one member relative to another member such as on items with extendable arms or legs. It will be apparent that many useful modifications of the device are possible without departing from the fundamental basis of the invention and the illustrations and examples provided herein are for explanatory purposes only and are not intended to limit the scope of the appended claims.

I claim:

1. A positioning mechanism comprising: a structural member, a shroud, said shroud displaceable along said structural member, said structural member comprising a plurality of notches, a shuttle, said shuttle defining a horizontal cavity, said shuttle disposed within said shroud, a trigger member, said trigger member longitudinally slidably disposed proximate said shuttle and said structural member, coincidental with said horizontal cavity, an independent lock said trigger member defining a biased slot, said biased slot partially pin, said independent lock pin movably positioned within said biased slot and said horizontal cavity, whereby raising said trigger member will cause said lock pin to move along said horizontal cavity away from said notches and release of said trigger member will cause said lock pin to move toward said notches for engagement therewith.

2. The positioning mechanism of claim 1 wherein said trigger member is disposed between said shuttle and said shroud.

3. The positioning mechanism of claim 1 and including a resilient member that engages said trigger member.

4. The positioning mechanism of claim 3 wherein said resilient member comprises a coil spring that urges said trigger member downwardly.

5. A positioning mechanism to allow the height of a chair arm to be adjusted comprising: an upright structural member, an armrest shroud, said shroud displaceable along said structural member, a shuttle disposed within said shroud , said shuttle defining a horizontal cavity, a trigger member, said trigger member longitudinally movably contained within said shroud, said trigger member defining a slanted slot, said horizontal cavity partially coincidental with said slanted slot, a lock pin, said lock pin positioned in said slanted slot and said horizontal cavity, said structural member defining a plurality of notches, said notches proximate said shuttle for reception of said lock pin, whereby raising said trigger member will cause said lock pin to move away from said notches and lowering said trigger member will cause said lock pin to approach said notches for engagement therewith to thereby secure said structural member relative to said shroud.

6. The positioning mechanism of claim 5 and including a resilient member, said resilient member contacting said trigger member to maintain said trigger member in a lowered posture.

7. The positioning mechanism of claim 5 and including a finger tab, said finger tab attached to said trigger member.

8. A mechanism for the relative positioning of telescoping members, comprising:

a structural member;

a notched member affixed to said structural member;

a hollow shroud telescopically and slidably engaging said structural member;

a shuttle member disposed within and immovable relative to said shroud and in slidable contact with said notched member; and means for restricting movement of said shuttle member relative to said notched member.

9. The mechanism according to claim 8, further comprising means for preventing said shroud from escaping engagement with said structural member.

10. The mechanism according to claim 8, wherein said shuttle member and said notched member are generally planar in shape, and said shuttle member and said notched member are disposed side-by-side, occupying the same spacial plane.

11. The mechanism according to claim 8, wherein said shuttle member has a horizontal slot for alignment with notches of said notched member.

12. The mechanism according to claim 11, wherein said movement restricting means is a lock pin slidably retained within the horizontal slot of said shuttle member for engagement with a notch of said notched member.

13. The mechanism according to claim 12, wherein said lock pin is cylindrically shaped.

14. The mechanism according to claim 12, wherein said lock pin is unattached and independent.

15. The mechanism according to claim 12, further comprising means for disengaging said lock pin from said notched member.

16. The mechanism according to claim 15, wherein said disengagement means is slidably disposed between said shuttle member and the inner wall of said shroud.

17. The mechanism according to claim 15, wherein said disengagement means is a longitudinal trigger member having a slanted slot, said lock pin slidably disposed within the slanted slot.

18. The mechanism according to claim 17, wherein one end of the slanted slot is coincidental with the horizontal slot of said shuttle member.

19. The mechanism according to claim 17, wherein said trigger member is free to slidably move parallel to its longitudinal axis.

20. The mechanism according to claim 17, further comprising means for downwardly urging said trigger member.

* * * * *

UNITED STATES PATENT AND TRADEMARK OFFICE

CERTIFICATE OF CORRECTION

PATENT NO. : 5,388,892

DATED : February 14, 1995

INVENTOR(S) : Lino E. Tornero

It is certified that error appears in the above-indentified patent and that said Letters Patent is hereby corrected as shown below:

In claim 1, column 4, lines 62-63,
delete: "coincidental with said horizontal cavity, an independent lock"

and,
column 4, line 64, immediately after "partially", insert: --coincidental with said horizontal cavity, an independent lock--.

Signed and Sealed this

Twenty-third Day of May, 1995

*Attest:*

Bruce Lehman

BRUCE LEHMAN

*Attesting Officer*

*Commissioner of Patents and Trademarks*